United States Patent [19]

Vuillaume

[11] Patent Number: 4,691,417

[45] Date of Patent: Sep. 8, 1987

[54] DEVICE FOR THE MANUFACTURE OF NON-WOVEN FABRICS WITH IMPRESSED OR EMBOSSED DESIGNS

[76] Inventor: Andre Vuillaume, 63 Clos de Franquieres, Bivierd (Isere), France

[21] Appl. No.: 553,360

[22] Filed: Nov. 18, 1983

[30] Foreign Application Priority Data

Nov. 19, 1982 [FR] France ..... 82 19716

[51] Int. Cl.[4] ..... D04H 18/00

[52] U.S. Cl. ..... 28/105

[58] Field of Search ..... 28/104, 105

[56] References Cited

U.S. PATENT DOCUMENTS

| | | | |
|---|---|---|---|
| 3,284,857 | 11/1966 | Hynek | 28/105 |
| 3,330,009 | 7/1967 | Hynek | 28/105 |
| 3,768,121 | 10/1973 | Kalwaites | 28/105 |
| 4,024,612 | 5/1977 | Contractor et al. | 28/105 |
| 4,085,485 | 4/1978 | Brandon et al. | 28/104 |
| 4,497,095 | 2/1985 | Minemura et al. | 26/2 R |

*Primary Examiner*—Robert R. Mackey

*Attorney, Agent, or Firm*—Harry M. Weiss & Associates

[57] ABSTRACT

The invention involves an injector which propels a curtain of water through perforations in a rotating cylinder.

The curtain of water hits a non-woven fiber sheet at an angle, and the splashback is collected in a suction chamber. The width of the curtain of water is adjustable, and self-cleaning of the injector can take place while the machine is in operation.

The invention is used for the production of perforations or embossed designs on non-woven fabric whether the fiber sheet is produced by the dry method or the wet method.

4 Claims, 8 Drawing Figures

DEVICE FOR THE MANUFACTURE OF NON-WOVEN FABRICS WITH IMPRESSED OR EMBOSSED DESIGNS

BACKGROUND OF THE INVENTION

This invention concerns a new device for the manufacture of non-woven fabrics having embossed or impressed designs, or even with perforations.

The invention also covers a new industrial product, namely the manufacture of the non-woven fabrics produced by the device described in the invention.

Perforated non-woven fabrics are well-known, especially for applications in the fields of medicine and hospital care, cleaning, filtering, etc.

For instance, there is the well-known French Patent No. 2,068,676 for transporting a sheet of wetted fibers on the porous material of a supporting conveyor belt. The fiber sheet is passed under a rotating perforated cylinder containing a hydraulic injector in the form of a fixed horizontal bar. The injector discharges a curtain of water under pressure, some of which passes through holes in the perforated cylinder. The water then penetrates the fiber sheeting in the appropriate places and is collected in a suction box below, located under the material of the conveyor belt, below the rotating cylinder.

This current device has several disadvantages. First of all, the lack of rigidity in the injector does not permit water to be injected under high pressure, nor is it possible to substantially reduce the thickness of the water curtain. In any case, it is difficult to control the thickness of the curtain with precision. Finally, since the curtain of water is directed perpendicularly onto the surface of the fiber sheet, there often occurs a problem with an overflow of water which is difficult to remove or pump out.

Furthermore, it has been calculated that the relatively weak kinetic energy of the curtain of water produced by most of the known machinery only permits treatment of lightweight fiber sheeting produced by the wetting method, i.e., fibers with limited bonded strength. Such machinery is often useless for fiber sheeting produced by dry methods.

The invention under review is aimed at eliminating these disadvantages, by producing an almost universally useful machine for the manufacture of non-woven fabric on which any kind of design can be imposed, whether it be in relief or impressed, or even perforated, and this would apply to fabrics produced by the wet or dry methods.

SUMMARY OF THE INVENTION

A device along the lines of the invention to obtain embossed or impressed designs on non-woven fiber sheeting, consists of a supporting fabric which advances with the fiber sheet beneath a revolving, perforated cylinder containing a fixed water injector installed horizontally to discharge a curtain of water at the fiber sheet. However, it is distinguished by the fact that on the one hand, the hydraulic injector consists of a high pressure water receiving chamber which drives the water toward two spouts which produce curtains of water directed at an oblique angle to the fiber sheeting, while on the other hand, there is a suction chamber to remove the splashback which pumps away the water overflow as well as the water splashed back into the cylinder.

Another feature of the invention is that the two trasverse spouts situated on each side of the curtains of water which they discharge consist of one fixed spout which forms an integral part of the injector, with a second spout which can be moved at right angles to the curtain of water through the use of controls which can be adjusted to control the distance between the two spouts, i.e., the thickness of the water curtain.

Another feature of the invention is that the adjuster on the movable spout consists of a counter-pressure chamber fed by pressurized water which is used to propel the movable spout toward the fixed spout. This arrangement has the following dual advantages:

on the one hand, it propels the rear surface of the movable spout smoothly toward the fixed spout, which means that the constant distance between the two spouts can be measured precisely, and this distance controls the thickness of the water curtain;

on the other hand, it means that the injector can be cleaned automatically, even while the machine is in operation, by simply releasing the counter-pressure in the rear chamber. In such an event, for a very short specified period of time, the pressure in the water reception chamber propells the mobile spout away from the fixed spout, temporarily increasing the width of the space between them, and enabling the automatic ejection of any impurities. This type of cleansing is essential if a curtain of water under very high pressure is to be used on extremely thin material, as thin as forty microns, for example.

The attached drawings, which are given as a non-restrictive example, are designed to enable better comprehension of the features of the invention.

DETAILED DESCRIPTION OF THE INVENTION

Figure 1:
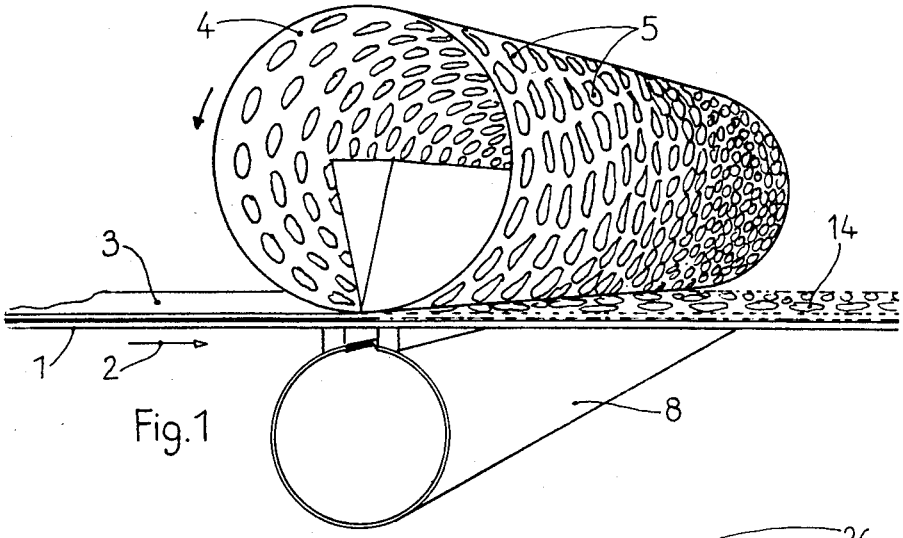
FIGS. 1, 2 and 3 illustrate three types of known machinery which could be used with a device covered by the invention.

In the machine shown in FIG. 1, the supporting material 1 moves in the direction indicated by the arrow 2. The material supports a sheet 3 of non-woven fibers. Both together 1 and 3 pass beneath a perforated, horizontal cylinder 4, whose perforations 5 are arranged in the pattern as shown. Naturally, the pattern and size of each perforation 5 vary in order to obtain the desired effect.

Figure 4:
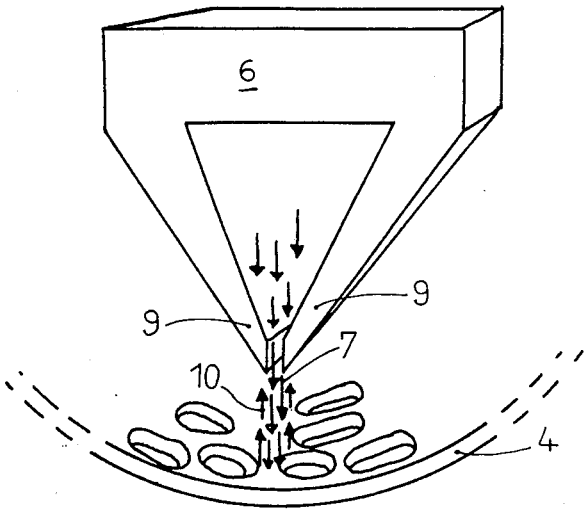
FIG. 4 shows an injector of the known type.
Figure 5:
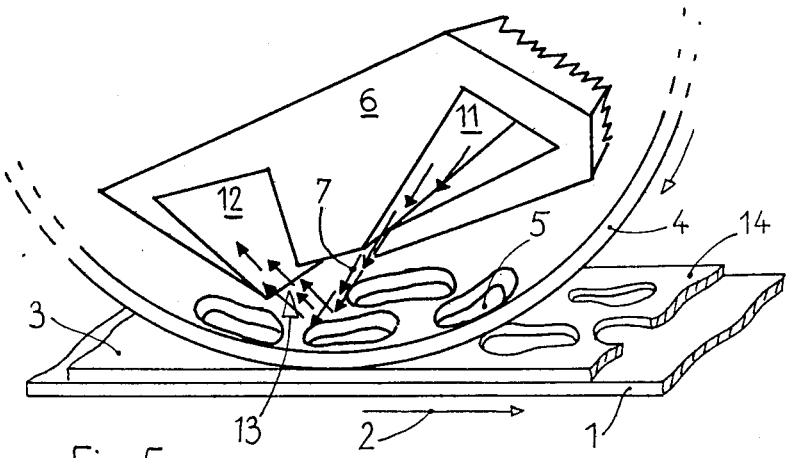
FIG. 5 shows a similar view of the injector of the present invention.

Inside the revolving cylinder 4, there is an injector in the form of a fixed horizontal bar, capable of discharging a curtain of water 7 downwards (FIGS. 4 and 5). The water passes through the perforations 5 and hits the sheet 3 of fibers.

Beneath the moving material 1, a horizontal suction box 8 can be placed, mounted in a fixed position, with a depression inside it.

In machines of the known type, the injector 6 (FIG. 4) has two fixed spouts 9, and the curtain of water forms between them, the curtain being directed at right angles to the sheet of fibers 3. This curtain of water 7 is therefore directed approximately within the diametric plane of the cylinder 4. The water repulsed by the solid portions of the cylinder 4 is propelled in the opposite direction to the curtain of water 7, as illustrated by the arrows 10. This considerably reduces the effectiveness of the machinery, and in particular prevents its use on a fiber sheet 3 produced by the dry method, i.e., one whose fibers are strongly bonded to each other. However, the injector 6 designed along the lines of the invention (FIGS. 5 and 6) discharges a curtain of water 7 which hits the fiber sheet 3 at an angle in relation to the norm at this location. Furthermore, in addition to the water reception chamber for the pressurized water 11, the injector 6 as per the invention has another perpendicular chamber 12 which contains a depression. This suction chamber 12 features a perpendicular slit 13 which lies parallel to the curtain of water 7 and is located in the actual catchment area for water splashed back against the internal cylinder wall. Due to this arrangement, a major portion of the overflow from the curtain of water 7 will be sucked back into the chamber 12, without having to pass through either the cylinder 4 or the fiber sheet 3. This arrangement also has the advantage of making it unnecessary to perforate the fiber sheet 3 which means that not only may actual perforations 15 be made in non-woven fabric 14 (FIGS. 1, 2, 3, 7, 8), but also impressions 16 which are unperforated with a background area 17 of reduced thickness.

Control over the size and arrangement of perforations 5, as well as control of the pressure in the water reception chamber 11 determines the presence of a background 17 (impressed areas 16) or the absence of one (perforations 15).

Figure 6:
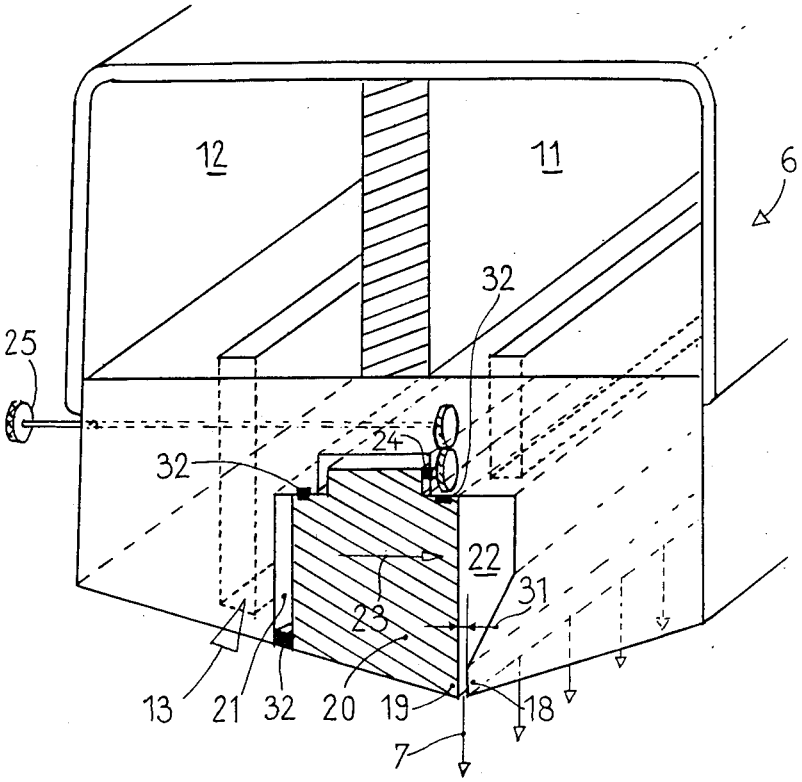
FIG. 6 shows another variation of the injector of the present invention.
Figure 7:
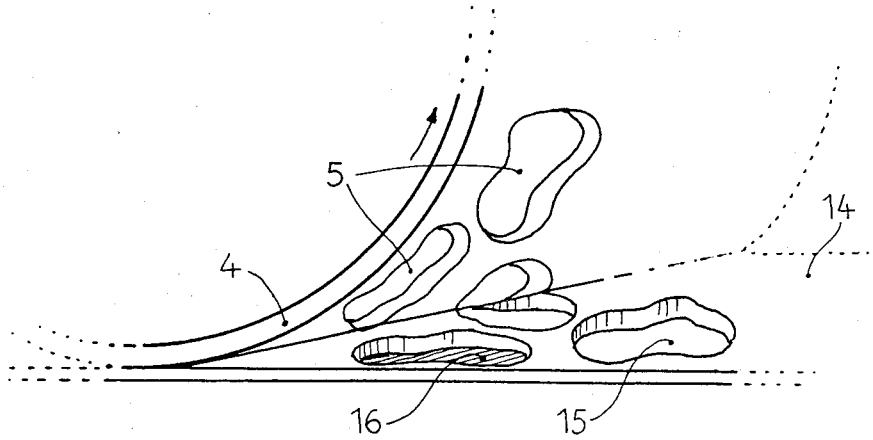
FIG. 7 shows the invented device in operation.
Figure 8:
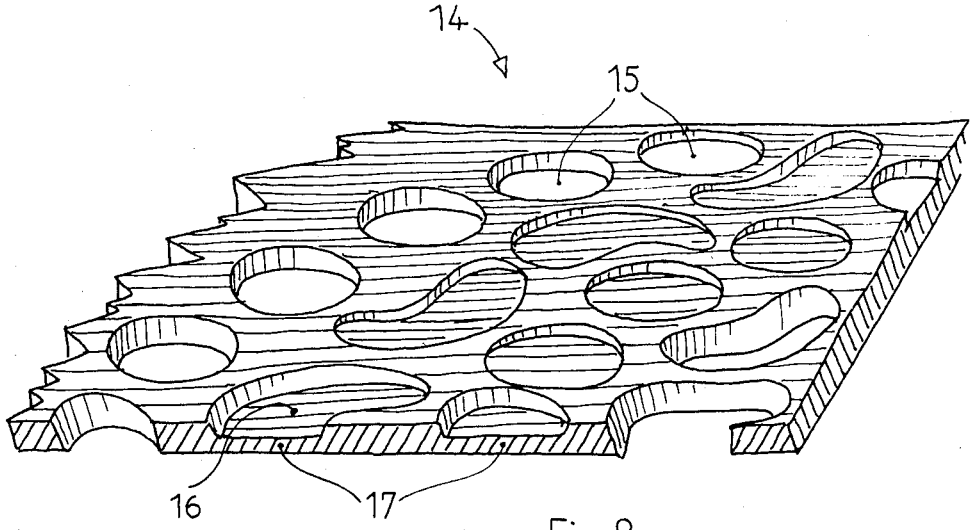
FIG. 8 shows an example of the non-woven fabric thus obtained which shows some perforations and elsewhere impressed designs.

In the variation illustrated in FIG. 6, the curtain of water 7 from the injector 6 according to the invention passes between two perpendicular spouts, i.e., a fixed spout 18 and a movable spout 19. The movable spout 19 is part of a lip or washer 20 which extends along the whole length of the injector 6 and which is linked to a rear counter-pressure chamber 21. This chamber is supplied with water at a pressure which should be higher than the pressure level in chamber 11 and consequently in the forward chamber 22. Thus, the hydraulic thrust in the rear chamber 21 propels the lip 20 along its whole length in the direction indicated in FIG. 6 by the arrow 23, thus tending to reduce the gap between the fixed spout 18 and the movable spout 19, i.e., reducing the thickness of the curtain of water 7. As it progresses toward the fixed spout 18 (arrow 23) the movable lip 20 is halted by stopper screws 24, whose position can be adjusted from the outside, for instance with a button or a wheel 25.

This arrangement has the following dual advantages:

on the one hand, the position of the movable lip 20 can be controlled, i.e., the width of the gap 31 separating the two spouts 18 and 19, so that the curtain of water 7 can be reduced to a very fine depth (for instance, it can be reduced as low as forty microns);

on the other hand, the spreading of counter-pressure in the chamber 21 along the whole length of the movable lip 20 ensures that the curtain of water 7 maintains an absolutely constant thickness along its whole length, even if this thickness if very reduced (thickness 31—FIG. 6).

Figure 2:
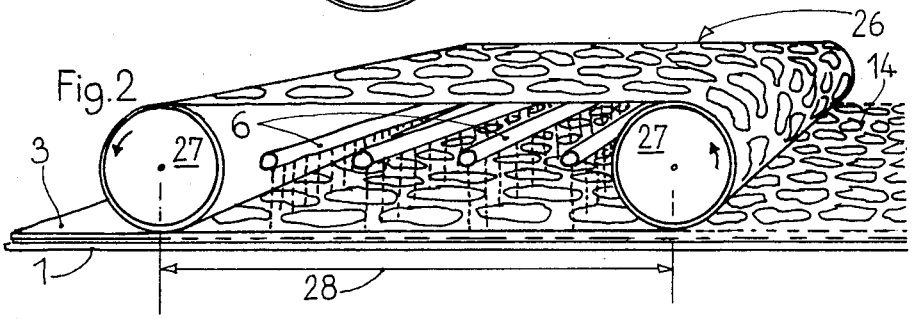
Figure 3:
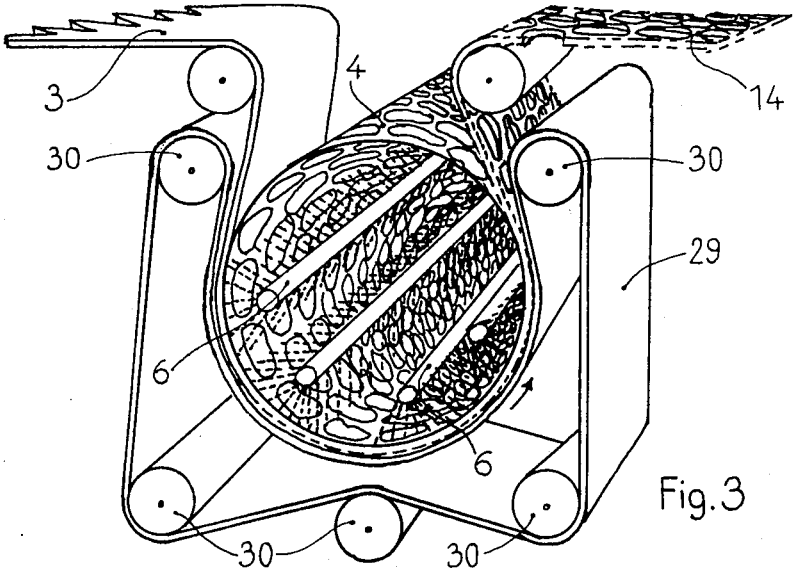

Injector 6 along the lines of the invention (FIGS. 5 and 6) can also be used on machines of the type illustrated in FIGS. 2 and 3.

FIG. 2 shows a continuous perforated fabric 26, revolving between two rollers 27 which presses the fiber sheet 3 along a length 28 against the supporting fabric 1. In this case, several injectors 6, four of them, for instance, are arranged side by side inside the perforated fabric 26 and between the rollers at each end.

In the machine illustrated in FIG. 3, the sheet 3 to be treated revolves around the perforated cylinder 4. It is pressed against the periphery of the cylinder by a continuous fabric 29, which applies it at a center angle which is eventually higher than 180°. Thus, several injectors 6 are spread along the internal periphery of the cylinder 4 (four in the case of FIG. 3). The continuous fabric 29, revolves around several fixed-axis rollers 30 to keep the unwoven sheet 3 pressed against the cylinder 4.

Of course, it only requires the release of hydraulic pressure in the chamber 21 for the movable spout 19 to suddenly move away from the fixed spout 18, thus allowing for the automatic discharge of any impurities present in the chamber 22. Immediately following this discharge, counter-pressure is restored in the chamber 21, and the movable spout 19 returns to be held against the screws 24. This self-cleaning operation has the advantage of being executable while the machine is in operation.

Hydraulic compensation of the pressures between chambers 21 and 22 enables the use of water pressure of up to 70 bars in the feeder chamber 11, without significantly distorting movable lip 20. This means that a curtain of water 7 of high kinetic energy can be supplied, which is capable of perforating a sheet 3 whose fibers are strongly bonded to each other. This means that fiber sheets produced by the dry method can be treated by this means.

Of course, an injector 6 designed according to the invention can easily be fed by weaker pressure, in fact it can operate over a pressure range of between 5 and 70 bars.

Furthermore, several waterproof joints 32, preferably suitable for expanding and contracting could be inserted between the mobile lip 20 and the fixed part of the injector 6.

Finally, the word "water" has been used throughout this text in a non-restrictive sense, it being understood that professionals use the word "water" as a synonym for "liquid" and it can be used to refer to any type of liquid.

While the invention has been particularly shown and described in reference to preferred embodiments thereof, it will be understood by those skilled in the art that changes in the form and details may be made therein without departing from the spirit and scope of the invention.

I claim:

1. A device for imprinting impressed or relief designs on a sheet of non-woven fibers, comprising:

perforated means for patterning said sheet of non-woven fibers;

supporting fabric means for supporting said sheet of non-woven fibers against said perforated patterning means;

hydraulic injector means for discharging a curtain of liquid at an oblique angle against said perforated patterning means; and suction chamber means for collecting liquid splashed from said perforated patterning means at an oblique angle, said hydraulic injector means and said suction chamber means being located on the same side of said perforated patterning means.

2. The device as in claim 1 further comprising:

fixed spout means for controlling the location of said curtain of liquid;

movable spout means for controlling the thickness of said curtain of liquid; and hydraulic adjusting means for controlling said movable spout means and for regulating the thickness of said curtain of liquid.

3. The device as in claim 2 further comprising an adjustable stopper screw means for stopping the movement of said movable spout means.

4. The device as in claim 2 further comprising pressure-regulating means for controlling the velocity of said curtain of liquid.

* * * * *